United States Patent [19]

Morley et al.

[11] Patent Number: 4,680,012

[45] Date of Patent: Jul. 14, 1987

[54] PROJECTED IMAGED WEAPON TRAINING APPARATUS

[75] Inventors: Robert A. Morley, Southport; James M. Buick, Stockport, both of England

[73] Assignee: Ferranti, plc, Cheadle, England

[21] Appl. No.: 743,803

[22] Filed: Jun. 12, 1985

[30] Foreign Application Priority Data

Jul. 7, 1984 [GB] United Kingdom ..... 8417402
Jan. 28, 1985 [GB] United Kingdom ..... 8502110

[51] Int. Cl.[4] ..... F41G 3/26; F41J 5/10

[52] U.S. Cl. ..... 434/22; 434/20; 273/310

[58] Field of Search ..... 434/20, 21, 22, 44; 273/310–316

[56] References Cited

U.S. PATENT DOCUMENTS

| | | | |
|---|---|---|---|
| 3,838,856 | 10/1974 | Takeya et al. | 434/20 |
| 3,849,910 | 11/1974 | Greenly . | |
| 4,137,651 | 2/1979 | Pardes et al. . | |
| 4,223,454 | 9/1980 | Mohon et al. . | |
| 4,269,415 | 5/1981 | Thorne-Booth | 273/310 |
| 4,336,018 | 6/1982 | Marshall et al. | 434/20 |
| 4,464,115 | 8/1984 | Simpson et al. | 434/21 |
| 4,534,735 | 8/1985 | Allard et al. | 434/20 |

FOREIGN PATENT DOCUMENTS 2047856 3/1980 United Kingdom .

*Primary Examiner*—Richard C. Pinkham
*Assistant Examiner*—MaryAnn Stoll Lastova
*Attorney, Agent, or Firm*—Dennis P. Clarke

[57] ABSTRACT

Apparatus (FIG. 1), for training in the rapid and accurate reaction to a situation confronting one or more trainees 12, 12' in an enclosed room 11, has one wall thereof formed by a screen portion 14 onto which an optical image is back-projected by projector 16. Each trainee's weapon 22 has a light emitter 24 responsive to firing the gun (containing blanks) at the screen to simulate the projectile impact point by spot 26. A television camera adjacent the projector and viewing the rear of the screen receives the spot and relates the position of this within the camera field to datum points of the projected image, the datum points 36' being visible to the camera and not the trainee. The scoring is analyzed by projecting onto the screen recorded video images including both the spot 26 and the reflected projected image and a store 29', containing the positional relationships between datum points and target areas, may be used with image processor 28 to determine quantitative relationships between simulated impact point 26 and the target area. A plurality of trainees may use the system together, each being allotted a light emission time window, synchronized with the camera scan to discriminate between them.

14 Claims, 4 Drawing Figures

PROJECTED IMAGED WEAPON TRAINING APPARATUS

Figure 1B:
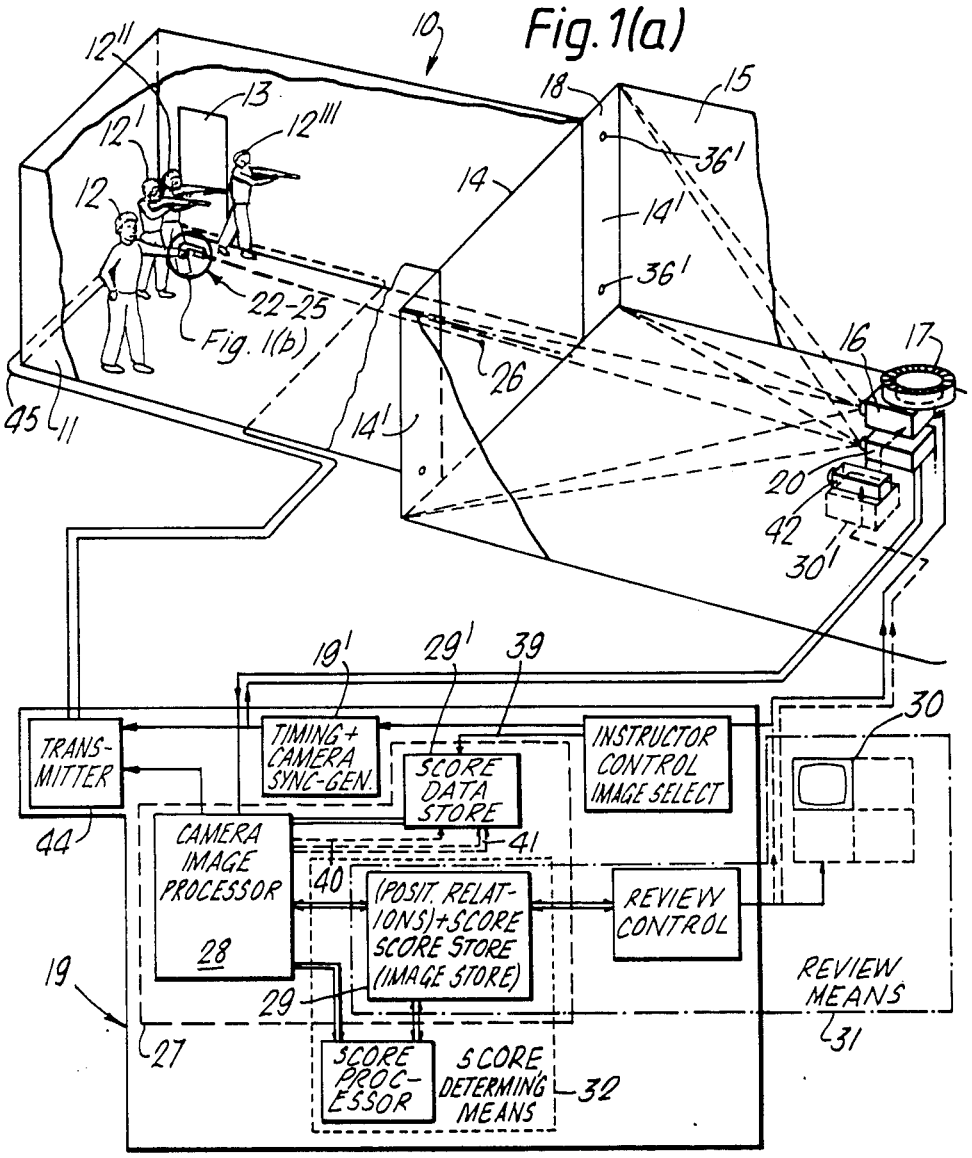

This invention relates to weapons training apparatus and particularly, but not exclusively, to the training selective marksmanship with hand-held firearms.

The training of marksmanship is well known in so-called static situations in which a trainee takes aim and fires a weapon at a relatively small target, in order to obtain maximum accuracy of shot, employing either real firearms, from which projectiles are fired at the target, or a simulated system in which a pulse or beam of optical radiation is 'fired' from a transmitter and impinges on a detector, each bearing a known relationship with respect to the weapon and target, and wherein a small target may be represented by an image produced on a screen by television or photographic transparency projection apparatus.

However, a need also exists for marksmanship training wherein the target comprises an area forming part of a larger potential target scene in which the trainee has to distinguish the desired target area from non-target areas both accurately and rapidly.

Such training is required, for example, to deal with a situation in which the armed trainee has to enter an enclosed area to confront at a distance of say, less than ten meters, a plurality of people, some of whom are armed or potentially armed enemies and some of whom are innocent prisoners or bystanders. The trainee has therefore to determine rapidly the position of his target area or areas and fire at them as accurately as possible within the short time interval before harm can befall himself or the 'non-targets'.

For realism such a target scene including potential target areas should be of the order of several meters square and for versatility of operation the target scene must be capable of frequent and ready change.

Weapon training apparatus of this type is known, for example, from U.S. Pat. Nos. 4,336,018, 4,223,454, 4,137,651 and 3,849,910 in which a target scene is formed by optical projection of an image, carried by photographic film, onto a screen.

In the first of the above mentioned specifications, the aim accuracy is determined by projecting a second, infra-red, image onto the screen and detecting reflected radiation therefrom by means of detectors carried with the weapon.

In the second and third of the above mentioned specifications, the weapon, or each of a plurality of weapons, carries a light source, such as a laser, which is directed at the projected image when the weapon is fired, and remote detectors determine from the path of reflected radiation its impact point with the target (the aim point).

In the fourth of the above mentioned specifications the screen on which the image is projected is formed from a cheap penetrable material, such as paper, and a projectile fired by a real weapon is used to make a hole in the screen at the aim point. Determination of aim accuracy is achieved by back-illumination of the screen and detection of position of the illuminated projectile hole in relation to the screen and the target features of the image projected thereon.

None of these specifications are particularly concerned with reviewing the efforts of a trainee marksman in showing at a later stage in graphical form the relationships between his aim points and the target scene.

It is an object of the present invention to provide weapon training apparatus which has a more informative score analysis than prior apparatus.

According to the present invention weapon training apparatus includes a back-projection screen of high optical transmissivity, a transmitting image projection means operable to form a visible target image on the screen by back-projection, means for changing the projected image, weapon sighting means, directable at the front of the screen by a trainee in a training area, including a weapon discharge trigger mechanism and an optical radiation emitter responsive to operation of the trigger mechanism to direct optical radiation at the screen to impinge thereon in a spot indicative of a simulated projectile impact point, a television camera, located on the same side of the screen as the projector and having a field of view substantially co-extensive with the image projected by the projector, operable to receive at least a part of the projected target image, reflected from the screen, and radiation forming said impact simulating spot, transmitted by the screen, simultaneously as a composite image and scoring analysis means operable to produce for viewing a visual composite image including the target scene and impact simulating spot.

Figure 1B:
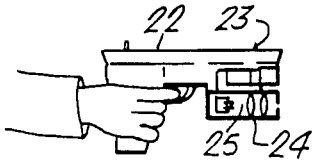
Figure 2:
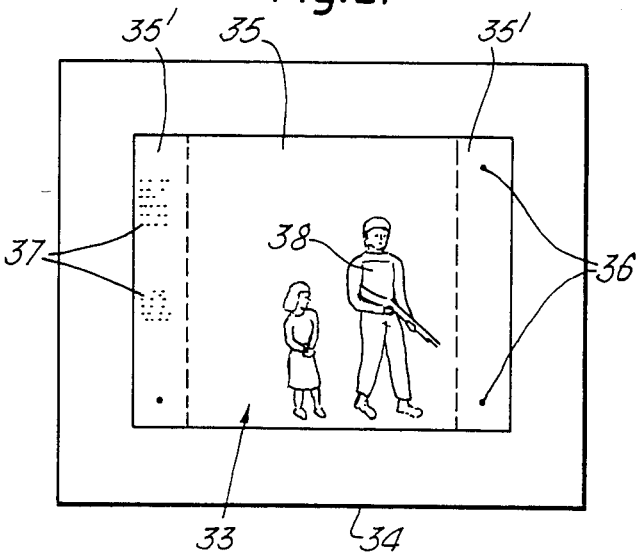
Figure 3:
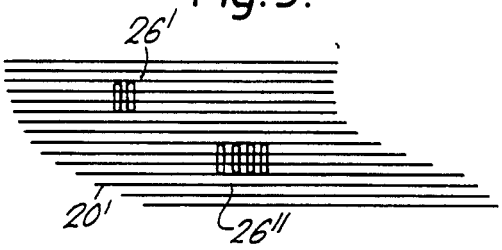

Embodiments of the invention will now be described by way of example with reference to the accompanying drawings in which:

FIG. 1(*a*) is a cut-away perspective representation of weapon training apparatus in accordance with the present invention, FIG. 1(*b*) shows an enlarged detail of FIG. 1(*a*) illustrating a weapon and optical emitter attached thereto, FIG. 2 is a representation of one form of photographic slide for projecting an optical image in the apparatus of FIG. 1(*a*), and FIG. 3 shows representations of images projected by different weapons onto a screen in accordance with one embodiment of the present invention.

Referring to FIG. 1(*a*) weapon training apparatus 10 comprises a training area defined by an enclosure 11 into which a trainee 12 gains access by way of a door 13.

The enclosure represents a typical room and one wall thereof is formed by a photographic projection screen portion 14. The screen is of a high optical transmissivity intended to show an optical image formed thereon by back-projection. The front of the screen faces into the room and typically has dimensions of the order of 3.5 meters wide by 2.5 meters high.

Adjacent the enclosure 11 is a projection room 15 containing an optical image projector 16. The projector contains a light source and optical elements of conventional design and is provided with a magazine 17 of 35 m.m., or larger format, photographic slide transparencies from which an image is projected onto a wall 18 of the projection room forming the screen for projector 16. The projection room wall 18 (projection screen) may be of the same dimensions as, and comprise, the enclosure wall 14 (viewing screen) or be larger, as described hereinafter, so that only a central portion thereof comprises the viewing screen portion 14. Projected slide transparencies may be changed for others in the magazine by remote control from control station 19.

Adjacent the projector 16 is a television camera 20, preferably capable of a high, say, 1000 line, resolution.

The camera is disposed with respect to the projector such that its field of view is substantially coextensive with the projector image.

When an image is projected onto the screen 18 and transmitted by the portion 14 the television camera 20 receives an image reflected from the screen. Although the intensity of reflected light may be some 50% of the incident light this is considerably less than is reflected from a normal projection screen (which may be some 80%).

The video signals from camera 20 are fed to scoring analysis means 21 in control station 19, the station also containing camera control means 19' including the generators of camera line and field scanning signals and other time functions which are also used within the control station.

The trainee 12 is armed with a hand gun 22 capable of firing blank rounds or ammunition of the type intended to retain the effects of recoil as well as noise. The gun, shown in detail enlargement FIG. 1(*b*), has integral sighting means 23 and an emitter 24 of optical radiation (hereinafter called light) clipped, or otherwise attached, to the barrel, the path of the emitted light being aligned with the sighting means. Conveniently this is infra-red light obtained from a laser diode 25 and suitably collimated or focused to form a spot 26 at the screen portion 14. The spot size is chosen to enable discrimination by the camera, that is one or two scanned raster lines across. In practice, with a screen portion 14 of the dimensions indicated and a 1000 line camera such a spot would have a diameter of the order of 0.4 m.m., that is, approximately the size of a hand gun projectile.

The emitter 24 is caused to emit light in response to operation of the trigger of the gun either directly, by a switching action resulting from trigger movement or indirectly, for example, as a result of the report caused by the gun discharge.

When the gun is discharged at a projected target scene image the emitted light simulating the projectile incident on the screen as spot 26 is transmitted by virtue of the screen's optical properties and forms with the reflected target scene image a composite image detected by the camera 20. Furthermore the intensity of the transmitted emitter light, particularly if "invisible" infra-red, may be chosen to produce a video signal having an amplitude considerably greater than that due to the reflected projector image, enabling processing of the signals to be more readily achieved, as will be described later.

When the trainee has finished firing one or more shots at one or more projected target scenes, which activities are generally required to be performed rapidly and with little time to observe the results of the action, it is desirable for the instructor and/or trainee to analyse the accuracy with which the weapon is aimed, that is, score the attempts and to this end said scoring analysis means 21 comprises storage means 27, such as a conventional video recorder (not shown) or a digital frame store formed by camera image processing means 28 and score storage means 29, to store the television camera frame showing this composite image and television display means 30 to show the retrieved stored composite image. The television display means 30 may be a monitor including a directly viewed CRT or a projection television system 30' in which the television image is displayed on a larger area, such as the viewing screen 14, conveniently by back projection onto projection screen 18.

Each time a shot is fired the camera video signal for one television frame representing the composite camera image is stored. Each frame may be stored separately in sequence so that the impact simulating spot of each shot attempt can be reviewed in relation to its position in the target scene. Alternatively the image signals for a plurality of shots at one target scene may be superimposed in the storage means resulting in a displayed target scene image in which all impact simulating spots are displayed simultaneously. This form of presentation is useful for showing the impact simulating spot distribution pattern and the trainee's ability to group shots as well as requiring a lesser amount of storage space. Furthermore, the reflected target scene image may be reinforced in brightness by successively stored identical signals.

As stated above, the reflected target scene image received by the television camera 20 is dim in relation to an impact simulating spot although suitable for recording and subsequently for forming a display. The reflected projected target scene, insofar as it forms part of the television camera image, may alternatively be usefully employed as a means of deriving positional relationships from which a suitable composite image can be generated for said scoring analysis display.

In one form, the scoring analysis means 21 at the control comprises the frame store formed by said camera image processing means 28 and score storage means 29, conveniently embodied in computer means such as a microprocessor operating in accordance with a sequence of program instructions, the image processing means being operable to determine from the video signal of the television camera the positional relationship between an impact simulating spot and one or more datum points defined on the camera-viewed (reflected) target scene and the storage means, shown as separate elements 29 and 29', being operable to store data pertaining to the positional relationship.

The scoring analysis means, stores separately a representation of the target scene and uses such computed and stored data in review means 31 to generate for viewing an image of the stored target scene and includes in the image the impact simulating spot, the positional relationship between spot and target scene being determined by the image processing means.

The scoring analysis means may comprise, in addition to the review means 31, score determining means 32 which may utilise the positional relationships between impact simulating spot and datum points determined by the image processing means to provide a quantitative assessment of the positional relationship between impact simulating spot and a target area of the scene.

Referring again to FIG. 1(*a*), the projection room 15 is wider than the enclosure 11, the projection screen forming one wall 18 thereof.

A central portion of the screen comprises the highly transmissive portion 14 forming the viewing screen wall of enclosure 11 and this is bordered by strips 14' offering greater reflectivity into the projection room.

Referring now to FIG. 2, this shows a representation of typical transparency 33 for projection carried in a mount 34. The transparency image is in three sections, the proportions of which correspond to the different regions of projection screen 18. A central portion 35' carries a photographic image of the target scene e.g. people and other details, whilst the surrounding strips 35' carry markings 36, forming datum points (36', FIG. 1(*a*)) on the projected image representing positioning data, and image identification data markings 37, described further hereinafter. When the transparency image in projector 16 is projected onto wall 18 the photographic image is visible from the enclosure 11 and (some 50%) of the image is reflected from portion 14 into the projection room.

On the other hand the projected data markings are not visible from enclosure 11 but clearly visible within the projection room, being reflected with greater luminous intensity than the projected target scene image.

Prior to operation, for each slide transparency 33 (FIG. 2) to be used, the positional relationship between the datum points 36 (hereinafter referred to as datum marks) and a target area, such as the body denoted by boundary 38, are determined and fed to score data storage means 29'.

In operation, when the slide is projected, the datum marks 36 are also projected appearing as datum marks 36' at the edge portions of the screen. Because of the reflective nature of these screen portions, the datum marks are strongly visible to the television camera 20.

Upon sight of the projected image the trainee 12 'fires' the weapon at what he perceives to be the appropriate target area and causes the resultant light spot 26 to be detected by the camera.

The video signals from the camera are fed to the image processing means 28 in which those signals due to the light spot 26 and datum marks 36' are readily discriminated from the signals of the reflected projected target image by their amplitude. The occurrences of the signals are determined as a function of camera field position by relating them to the scanning times defined by line and field sync. signals generated in the control station, the image processing means then determining the positional relationships between the simulated projectile impact point of spot 26 and the datum marks 36'.

Score determination is effected by score processing means 32' which compares this determined positional relationship with that in the score data storage means 29' for the particular transparency thereby providing a measure of the aim accuracy of the 'shot' to the target in terms of the positional relationship between the impact simulating spot 26 and target area. This positional relationship after determination may also be stored in the score storage means 29.

Alternatively, score determination may be effected simply as a binary 'hit' or 'miss' situation or more comprehensively as a function of the displacement of an impact simulating spot from the designated target area, which function may likewise be stored in the score storage means. Additionally, alternative target areas may be defined within the storage means where there is a choice of which target to shoot at. Similarly there may be defined non-target areas, such as the images of innocent bystanders or prisoners who must be avoided.

The trainee 12 may fire a plurality of shots in rapid succession at the projected target image each of which will be detected and an aim accuracy score given thereto.

The projector may be under the remote but direct manual control of an instructor who determines when each of a predetermined sequence of transparencies is to be projected, the selection of each new transparency from the magazine causing the appropriate stored data relating to the positional relationships between target areas and datum markings thereon to be retrieved from the score storage means.

If desired, the border portions 35' of the transparency which carry the datum marks 36 may also include identification data marks, such as represented by mark patterns 37 forming by their juxtaposition n-bit binary coded words. These word patterns are projected with the datum marks and are discriminated from the camera video signals by image processing means associated with the score storage means, for which the image processing means 28 may be employed. Such identification information may be employed by the scoring analysis means to retrieve the appropriate positional relationships from the score storage means for image processing and to ensure correct association of the scoring information with the target scene represented by the transparency. Such a facility also enables the projection of transparencies showing different target scenes in any order, enabling an element of unpredictability or repetition to be achieved without the need for manually sorting the slides in the magazine 17.

In yet another embodiment, the juxtaposition of identification data marks may actually comprise not only an identification of the particular target scene but also data representing the positional relationships between target areas and positional datum marks 36 thereby obviating the need for the score storage means to contain data for all the transparencies to be used, a small store being required to hold only the information relating to the currently projected transparency.

These three options of selecting the position data, that is manually under instructor control, automatically by transparency identification and by means of data in the projected image are illustrated by the paths 39, 40 and 41.

As stated above, the positional relationship between the datum points of the scene, in practice the datum marks 36 of the transparency, and the impact simulating spot is also employed by the review means to generate an image showing the aim accuracy, or position, of each impact simulating spot pictorially in relation to the complete target scene image.

The target scene image projected is stored in a separate preliminary operation, in image storage means 27, conveniently as a result of viewing an image by means of television camera (20 or otherwise) and storing the camera video signals in a video record device, i.e. magnetic video tape or video disc, or digitising them and storing them in other storage means such as score storage means 29.

In operation with a trainee, the television camera receives said composite image and the camera generated video signals thereof, applied to the image processing means 28 enables the position of an impact simulating spot 26 to be determined in relation to the television camera image frame (or with further processing, in relation to datum points as represented by datum marks) and the positional information stored in score data store 29'.

The review means 31 includes television display means, such as the aforementioned monitor 30 with a C.R.T. or a projection television system, preferably using at least a part of the screen portion 14. The image storage means is operated under the control of the review means to produce a video signal for the television display means. The review means also modifies this video signal adding at a position within the television frame, corresponding to the position in the camera frame of the impact simulating spot, a signal which appears in the displayed image as an impact simulating spot.

Depending upon the type of storage medium employed it will be appreciated that the camera generated image of the spot 26 may be stored by superimposition of the video signal (or its digitised equivalent) directly upon the stored target scene record.

Where the television display means takes the form of a projection television system, whereby the video image produced by television projector 30' is produced on the screen 14 for viewing from the enclosure 11, instead of modifying the display video signal to incorporate a spot producing signal, the review means may incorporate a steerable spot projector 42 to project a spot onto the screen at a location determined by the image processing means from the relationship between the video signal representing the spot position camera image frame scan parameters. Such an arrangement of generating a composite image has the advantage of not requiring camera detection or storage of the reflected projected target image in sufficient detail for viewing, only the relatively bright 'points' of the impact simulating spot, datum marks and possibly the identification data marks, enabling a simplified camera to be employed.

The scoring analysis means may take yet another form in which the image storage means comprises the optical projector and its magazine of target scene transparencies, operable under the control of the review means, which includes the screen 14, to cause the projector to generate by optical projection the target scene image on the screen. The review means also includes the above mentioned steerable spot projector 42 by which the impact simulating spot is superimposed on the image visible in the training area, the position of the spot being determined substantially as descirbed above by the image processing means. However it is possible to determine the position of the impact simulating spot in relation to the datum points of the projected image such that the spot projector is steered in relation to these points rather than as a function of the television camera frame.

In generating a target scene image by means of the projector 16 it may generally be assumed that the alignment of the image is unchanged from that of the initial projection for the trainee. However, if desired, the television camera 20 may be operable under control also of the review means to apply video signals to the image processing means whereby the registration between datum marks for each projection is verified or the offset computed and employed to correct the position to which the projected spot is steered.

As considered above, a trainee may make a plurality of shot attempts at a particular target scene image and the scoring analysis means is ready suited for displaying a single reviewed target scene image including all impact simulating spots or a sequential showing of the impact simulating spots for each to be appraised.

In order to identify the impact simulating spots with their order in the firing sequence the scoring analysis means may include impact simulating spot source discrimination means to relate each of a plurality of impact simulating spots detected in relation to a target scene to appropriate ones of a plurality of weapon firing at the target screen image.

It will be appreciated that within the scoring analysis means the image storage means and image processing means may take a variety of configurations. For instance, the video signals produced by the camera upon receipt of the composite image may be processed in the image processing means and the positional relationships data stored in chronological order or with a 'tag' indicative of the chronological order for subsequent retrieval by the review means or score determining means. This is particularly applicable where the image store is of the type, such as a video disc which is not readily written to, or a digital frame store of limited capacity. When the image store takes the form of a conventional video tape recorder (with recording facility by which the target scene image is stored) then the camera video signals of each composite image may be stored, inherently in chronological order the image processing being performed at a later time by retrieving the recorded camera video signals.

Notwithstanding that it is preferred to use infra-red radiation it will be appreciated that because of the relatively poor reflective properties of the screen the trainee would have difficulty in perceiving the whereabouts of the impact simulating spot, even if the radiation were in the visible part of the spectrum. If it is desired to provide 'real-time' optical feedback to the trainee then image processing may be effected on the current camera video signal and the calculated spot position be used to direct a steerable spot projector, such as that 42, to the position of spot 26 where the visible spot it produces will be observable by the trainee. The spot may be guided as to position within a short time interval, comparable within a frame period, but may be illuminated for several periods to register with the trainee.

The above description has related in general to a single 'shot' at a particular target image although it will be appreciated that frequently, when a trainee takes several such shots in sequence, either at the same target area or dispersed amongst several such target areas, the time interval between such shots, even when made rapidly, will be greater than the frame scanning rate of the television camera so that each impact simulating spot can be treated in relation to the camera frame in which the image is formed and the chronological relationship between the camera frame scans serves to identify the order of shots. That is, the detection of each impact simulating spot is related to the weapon firing action of the sequence.

It is frequently required, in realistically simulating shooting operations for a plurality of trainees such as 12, 12', 12'' etc. to shoot in concert at a target, firing individually at will, each trainee firing possibly a plurality of shots.

The apparatus includes a plurality of said weapon sighting means, in this case a hand gun complete with sight and optical emitter for each trainee.

To enable discrimination of projectile-simulating light beams from each trainee with respect to the target image the source discrimination means is provided which may include optical means associated with each light emitter such that it emits a beam forming a spot 26 which has distinctive optical attributes characteristic of the emitter. For example, each emitter may include masking means containing a pattern of slits or other optical means whereby the emitted radiation beam is split into a number of parallel beams which form 'spot' pattern 26' or 26'' on the screen as shown in FIG. 3. As such 'spot'patterns are scanned by the camera (as represented by scanning lines 20') the video signal is formed as a number of sequential portions, extending over a plurality of successive scan lines, by which the number of spot portions may readily be deduced by the image processing means in order to identify the source emitter. The relationship between the portions may be other than the total number, e.g. their spacing. Such an arrangement permits discrimination of simultaneously fired weapons.

In an alternative arrangement of source discrimination means each emitter 24 has associated therewith a receiver of radiated enabling signals, which receiver may conveniently be carried by the trainee rather than the gun and connected thereto by unobtrusive flexible wiring. The control station 19 includes an identification transmitter 44 which, in synchronism with the field scanning signals of the television camera system, transmits signals enabling each emitter in succession to emit radiation during a predetermined period, or 'window', of at least one frame period. Thus irrespective of when each trigger is actuated the camera 20 is able to perceive the light emission from one (known) weapon only in any single field image generated. Multiplexing means multiplexes the video information of successively formed television camera images in the scoring analysis means in accordance with said successive enabling of the emitters and positional relationships data and derived therefrom may then be to separate channels associated with the weapons or, indeed with the trainees, for score analysis.

The identification-transmission system conveniently operates at radio frequency and comprises a loop aerial 45 surrounding the enclosure 14 and the receivers are responsive only to the enabling signals within the training area.

It will be appreciated that when each weapon is fired there will probably be a delay until the next emission window. Assuming an image scanning period of 1/25th or 1/30th second then with four weapons in use a maximum delay of less than 100 milliseconds may be experienced which ensures the beam is emitted to the aim point before the mechanical motions in the gun disturbs the aim.

Such a control signal transmission arrangement may also conveniently enable the instructor to stand in the enclosure to direct the projection of different target scene images and to direct the scoring analysis.

In respect of scoring analysis, where there are a plurality of trainees, the recorded visual information may be displayed for the trainee in any of the ways mentioned above for a plurality of shots fired by any one trainee. For example, the visual information may be displayed for each trainee in succession on a single monitor 30 or projection system 30' or for all trainees simultaneously in a visually distinctive manner. For instance, the monitor 30 may be expanded to comprise a bank of monitors, one for each trainee, shown by broken lines or in a projection television system a similar number of projectors may utilize the screen 14 divided into sections accordingly. Alternatively, a television display system may have a split-screen display showing said plurality of images or a single target scene image in which the impact simulating spots are of different shapes. A monochrome television system would be adequate for this purpose.

Alternatively, a single color television system may be employed to provide the visual distinctiveness, distinguishing the efforts of different trainees by different colors and/or format information.

Also, where the review means controls the projection of separate target scene and spot images the target image may be re-transmitted with the trainees' aim points being displayed by suitably projected spots, distinguished by color or by shape.

It will be appreciated that many variations may be made to the above system without departing from the scope of the invention, both in making the apparatus more complex or more simple.

The apparatus as described above employs specifically prepared slides which carry both positional datum marks and image identification data.

If desired datum points may be formed not by markings 36 but by features of the target scene itself or by the comparison of all or part of the received reflected projector image with a corresponding image held in a score data store formed by a video frame store.

Alternatively, slides containing just target scene images without such additional markings may be employed, the scoring analysis means including an accurately predefined physical alignment between the projector 16, the camera 20 and projection screen 18 whereby a particular feature of the projected target scene image is caused to appear at a definite position within the camera image. The score data store 29' contains data representing the position or positions of such features with respect to the boundaries of the camera image field to enable the image processing means to determine the scoring position of the detected spot 26. Points such as the edge of the projected image may define the datum position for all slides. The screen portions 14' are then no longer required.

In the above described arrangements in which target positional information is stored in the data store, such information may be obtained in a form suitable for storage by projecting each image transparency onto the screen and marking or outlining the target area or areas with a light source, held to the screen.

Video signals from camera 20 are passed to the image processing means which in a process which determines the positions of the target areas or boundaries with respect to the datum marks which are to be used in processing the operationally received image containing spot 26.

Yet another alternative involves the use not of a succession of still slide transparencies but of cine film offering continuous motion in the target scene. The techniques described above are directly applicable although there are several additional constraints which should be mentioned. For instance, the camera scanning should be synchronised with the film projection speed in order to obtain a succession of full composite television camera images.

If a moving target image is projected then it is desirable in scoring analysis to stop, or 'freeze', the displayed image in any frame in which an impact simulating spot ocurs. In the simplest of embodiments in which the scoring analysis means comprises a means of recording the composite image video signals then the recording may include markers or flags, designating any recorded frame in which an impact simulating spot is present, said flags being used to stop the recorded material on playback in any frame so designated to enable a review and analysis by the instructor and/or trainee. Such flags may be derived from the video signal by means of a simple video amplitude threshold detector, when the transmitted laser radiation is of larger amplitude than the remaining video signal, or by an additional detector (not shown) behind the screen and tuned to the emitter, or by other weapon-specific signals as described above, so as to provide a distinctive signal when the gun is 'fired' which can be used for recording a flag.

It will be appreciated that such designation of frames containing an impact simulating spot is applicable also to a procedure, as described hereinbefore, whereby the camera video signals are stored by video recording means and the image processing is performed later during scoring analysis. Such flags may be employed to designate those video frames containing an impact simulating spot so that no time is wasted on processing other frames containing the target scene image only.

The image projector as described in the specific embodiment and variations thereof is one which operates on photograhic principles in projecting a beam of light through a photographically prepared image transparency, whether in the form of a static slide or cine film. It will be appreciated that the projector may comprise a projection television system whereby a two dimensional target scene image is produced on projection screen 18 by a scanned light spot modulated by electrical signals to define the image. In such a case the image defining signals are stored in suitable electrically addressable storage means, such as a semiconductor store or magnet disc or tape or video disc, and during analysis stored signals defining the position of spot 26 are readily employed to modify the image as it is projected again. Furthermore, as indicated above, if the storage means is suitable it may be employed as the score store and score data stores 29 and 29' to store the position of the impact simulating spot, not as positional data but as a modification to the stored form of video signal.

The above description has related principally to apparatus in which, when position information relating to the impact simulting spot is derived by the image processing means to effect regeneration of the composite image, the aim accuracy is also determined and made available. It will be appreciated that as with the first described basic embodiment, the aim accuracy provision may be omitted.

However, where such aim accuracy score is provided it may be presented in alphanumeric form either separately from, or superimposed on the composite image presented by the score analysis means.

It will be appreciated that the apparatus is not restricted to use with hand guns and other weapons, not necessarily hand-held, may be employed. Also, although the use of a clip-on emitter 24 enables the trainee to use his own weapon or one with which he is familiar, it is of course possible to use simulated weapons in which the emitter is integrally built. The emitting elements may emit optical radiation in the part of the spectrum which the emitter screen and camera are optically sensitive and these need not, of course, be in the visible part of the spectrum. Furthermore the emitter may not be a laser diode but a suitably intense 'conventional' optical source, such as a photographic flash unit.

In the above described embodiments the weapon sight is an integral part of the weapon so that in practice the emitting means is carried by the weapon, although aligned with the sight thereof. It will be appreciated that in other forms of weapon the sighting means may be separate from the weapon, such as with stabilised sights employed in tanks, helicopters and like vehicles. In such an arrangement the emitter is carried by, or slaved to motion of, the sighting means rather than a weapon, which weapon need not then form part of the apparatus, just the sighting means and a form of triggering means by which such a weapon would be fired.

What is claimed is:

1. Weapon training apparatus including a high optical transmission back-projection screen of high optical transmissivity; image projection means operable to form a visible target image on the screen by back-projection, said image including one or more datum points; means for changing the projected image; weapon sighting means, directable at the front of the screen by a trainee in a training area, including a weapon discharge trigger mechanism and an optical radiation emitter responsive to operation of the trigger mechanism to direct optical radiation at the screen to impinge thereon in a spot indicative of a simulated projectile impact point; a television camera, located on the same side of the screen as the projector and having a field of view substantially co-extensive with the image projected by the projector, operable to receive at least a part of the projected target image, reflected from the screen, and radiation forming said impact simulating spot, transmitted by the screen, simultaneously as a composite image; and scoring analysis means comprising image processing means operable to determine from the camera video signal the positional relationship between the impact simulating spot and said datum points defined on the camera-viewed target scene, data storage means operable to store data pertaining to said positional relationship and review means including the screen and means to cause said projector to project onto the screen for viewing an image of said target scene including the impact simulating spot in the positional relationship therewith determined by the image processing means.

2. Apparatus as claimed in claim 1 in which the review means includes means to project an image representing the impact simulating spot onto the projected target scene image.

3. Weapon training apparatus including a high optical transmission back-projection screen of high optical transmissivity; image projection means operable to form a visible target image on the screen by back-projection, said image including one or more datum points; means for changing the projected image; weapon sighting means, directable at the front of the screen by a trainee in a training area, including a weapon discharge trigger mechanism and an optical radiation emitter responsive to operation of the trigger mechanism to direct optical radiation at the screen to impinge thereon in a spot indicative of a simulated projectile impact point; a television camera, located on the same side of the screen as the projector and having a field of view substantially co-extensive with the image projected by the projector, operable to receive at least a part of the projected target image, reflected from the screen, and radiation forming said impact simulating spot, transmitted by the screen, simultaneously as a composite image; and scoring analysis means comprising image processing means operable to determine from the camera video signal the positional relationship between the impact simulating spot and said datum points defined on the camera-viewed target scene, data storage means operable to store data pertaining to said positional relationship, image storage means comprising a video record device for producing a video signal representing the target scene and review means, including television display means, operable to generate on the television display means a visual composite image of the target scene, produced by the video record device, and the impact simulating spot.

4. Apparatus as claimed in claim 3 in which the video record device comprises a recording device arranged to receive and store signals produced by the camera viewing a projected image of the target scene in the absence of an impact simulating spot.

5. Apparatus as claimed in claim 3 in which the television display means comprises a projection television system.

6. Apparatus as claimed in claim 5 in which the projection television system is operable to project a television image onto said target screen.

7. Apparatus as claimed in claim 3 in which the review means is operable to modify the video signal representing the target scene image in accordance with the data of the image processing means to include in the displayed image a visible representation of each input simulating spot determined from the camera video image signal.

8. Apparatus as claimed in claim 5 in which the review means includes means to project an image representing the impact simulating spot onto the projected target scene image.

9. Apparatus as claimed in claim 3 in which the screen is arranged to have different areas visible to the trainee and camera, the area thereof visible to the trainee comprising that occupied by the projected target scene and the area thereof visible to the camera comprising that occupied by the projected target scene image and said datum points projected with the target scene image and disposed separate from, but adjacent to, the target scene and caused to be reflected to the camera with greater luminous intensity than the target scene image, and in which the image processing means includes means to process the camera video signal of said composite image to distinguish therein signal features attributable to said datum points of the reflected projected image as a function of their position in the camera image and signal features attributable to an impact simulating spot transmitted by the screen as a function of its position in the camera image.

10. Apparatus as claimed in claim 9 in which the juxtaposition of datum marks represents identification data relating to the target scene and said image processing means is operable to determine said identification data from the relative occurrence of said datum marks in the camera video signal.

11. Apparatus as claimed in claim 3 in which the image processing means includes means to process the camera video signal of said composite image to distinguish therein signal features attributable to datum points of the reflected projected image as a function of their position in the camera image and signal features attributable to an impact simulating spot transmitted by the screen as a function of its position in the camera image, and in which the scoring analysis means includes score determining means comprising score storage means, storing positional data relating the position of at least one target area of the target scene to projected datum points as a particular juxtaposition of datum points projected with that target scene image, and score processing means operable to determine from the image processing means the positional relationship between said juxtaposed datum points and thus the stored positional relationship between datum points and target area represented thereby, and from said stored positional relationship and the determined positional relationship between an impact simulating spot and the datum points the positional relationship between the impact simulating spot and a target area.

12. Apparatus as claimed in claim 3 including a plurality of said weapon sighting means operable by a plurality of trainees at will and impact simulating spot source discrimination means operable to relate each of a plurality of impact simulating spots detected in relation to a target scene to appropriate ones of a plurality of weapon firings at the target scene, said source discrimination means including optical masking means, associated with each emitter, causing formation of an impact simulating spot on the screen having distinctive optical attributes characteristic of the emitter and the video signal of which is divisible by the image processing means into a number of portions the relationship between them being said emitter characteristic.

13. Apparatus as claimed in claim 12 in which the optical means is arranged to produce an impact simulating spot divided into a sequence of area portions, manifested as corresponding sequence of pulse signals in the video signal, the number of such pulse signals in the sequence being characteristic of the emitter.

14. Apparatus as claimed in claim 3 including a plurality of said weapon sighting means, each operable by one of a plurality of trainees at will, and impact simulating spot source discrimination means operable to relate each of a plurality of impact simulating spots detected in relation to a target scene to appropriate ones of a plurality of weapon firings at the target scene, the source discrimination means comprising a signal receiver, associated with an optical radiation emitter of each sighting means, responsive to transmitted enabling signals to enable, for a predetermined period, radiation emission from the emitter upon trigger actuation by the trainee and a transmission system operable to transmit said enabling signals to said receiver in synchronism with the television camera field scanning such that the emitters are enabled in turn for at least one camera frame period at a time, and multiplexing means operable to multiplex successively formed television camera images in the scoring analysis means in accordance with the successive enabling of emitters.

* * * * *